United States Patent [19]

Johnson

[11] Patent Number: 4,498,488

[45] Date of Patent: Feb. 12, 1985

[54] CIGARETTE FILTER

[75] Inventor: Robert R. Johnson, Louisville, Ky.

[73] Assignee: Brown & Williamson Tobacco Corporation, Louisville, Ky.

[21] Appl. No.: 451,892

[22] Filed: Dec. 21, 1980

Related U.S. Application Data

[63] Continuation of Ser. No. 243,168, Mar. 12, 1981, Pat. No. 4,365,641, which is a continuation-in-part of Ser. No. 29,230, Apr. 11, 1979, Pat. No. 4,256,122.

[51] Int. Cl.[3] ..... A24D 3/04

[52] U.S. Cl. ..... 131/336

[58] Field of Search ..... 131/336, 339, 340

[56] References Cited

U.S. PATENT DOCUMENTS

| | | | |
|---|---|---|---|
| 3,773,883 | 11/1973 | Labbe et al. | 131/339 X |
| 3,910,288 | 10/1975 | Hammersmith et al. | 131/339 |
| 3,958,579 | 5/1976 | Baker | 131/339 |
| 4,022,221 | 5/1977 | Berger | 131/339 |
| 4,082,098 | 4/1978 | Owens | 131/336 X |
| 4,135,523 | 1/1979 | Luke et al. | 131/336 |

*Primary Examiner*—V. Millin

*Attorney, Agent, or Firm*—Charles G. Lamb

[57] ABSTRACT

A cigarette filter includes a porous filter element attached to a cigarette, the element circumscribed by ventilating air ducts with an impermeable barrier therebetween so that smoke travels down the filter element and ventilating air travels down the ducts during use. The size of the ducts, the number of ducts, and the flow rate of ventilating air is so defined that substantially all of the smoke is dispersed immediately upon exiting the filter element.

9 Claims, 3 Drawing Figures

CIGARETTE FILTER

CROSS REFERENCE TO RELATED APPLICATION

This application is a continuation of application Ser. No. 243,168, filed Mar. 12, 1981, now U.S. Pat. No. 4,365,641, which is a continuation-in-part of application Ser. No. 29,230, filed Apr. 11, 1979, now U.S. Pat. No. 4,256,122.

BACKGROUND OF THE INVENTION

1. Field of the Invention

This invention relates to filters for cigarettes. In one aspect it relates to a filter with novel ventilating means therein. In another respect the invention relates to a filter cigarette having flow directing ducts therein for directing ventilating air toward the mouth end of the filter to be mixed at the outlet surface thereof. In even another respect the invention relates to a high ventilation cigarette wherein the smoke leaving the filter is instantaneously dispersed.

2. Description of the Prior Art

It is well known in the art to said filters or tobacco wrappers to cigarettes which provide ventilating air means to bring in ambient air to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough thereby diluting the smoke in the stream. Also, the cigarette wrapper may be perforated at selected locations along the length of the cigarette which provides ports for the cigarette through which ventilating air enters. Even further, it is known to perforate the wrapper of the filter on the filter end of the cigarette to allow for ventilating air to enter the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. U.S. Pat. No. 3,490,461 relates to a filter for a cigarette wherein a tubular body of extruded thermoplastic material having a plurality of longitudinally extending grooves in the outer surface is joined to a filter element which is disposed within the tube or is adjacent thereto wherein ventilating air travels down the grooves and smoke travels through the tube. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; West German Pat. No. 2,302,677; British Pat. No. 1,414,745; British Pat. No. 1,360,612; British Pat. No. 1,360.611; and, U.S. Pat. No. 3,910,288, the aforementioned British patents being directed to non-wrapped acetate filters.

In the manufacture of most ultra-low tar cigarettes, those having less than 5 milligrams of tar per cigarette as determined by the method published by H. C. Pillsbury, et al for "Tar and Nicotine in Cigarette Smoke", J. Assoc. Offic. Anal. Chem. Vol. 52, pages 458–462, dated 1969, commonly referred to as the Federal Trade Commission's accepted test method for determining tar and nicotine deliveries of cigarettes, a large amount of ventilating air is used to dilute the smoke leaving the filter. In present filter cigarettes, this large ratio of ventilating air to smoke forms a sheath of air around the smoke so that very little taste is experienced by the smoker.

SUMMARY OF THE INVENTION

The present invention provides a filter ventilation system for a cigarette utilizing ducts or passages which are circumambiently spaced around the filter element of a cigarette filter. The present invention further provides a filter whereby ventilating air and smoke mix only at the outlet end of the filter. The present invention even further provides a cigarette filter whereby smoke exiting the filter is substantially instantaneously dispersed.

Various other features of the present invention will become obvious to those skilled in the art upon reading the disclosure set forth hereinafter.

In the present invention, ventilating air is brought in and around the smoke stream passing through the filter element of a cigarette in such a manner that just as the smoke exits the mouth end of the filter, it is thoroughly and instantaneously dispersed by and mixed with both ventilating and surrounding air. This mixing enables rapid contact of the highly diluted smoke with the taste and common chemical sense receptors throughout the smoker's mouth.

In order to accomplish this instant mixing just as the smoke leaves the filter, it has been found that by providing a cigarette filter with a number of ventilating air ducts (passages) around the filter element; a specific cross-sectional area range for the ventilating air ducts; and, specific ventilating air and smoke flow rates under defined smoke-draw conditions, this instantaneous mixing at the outlet surface of the filter can be obtained. It has been found that a filter for a cigarette which provides this instantaneous mixing or "instant turbidity" at the filter outlet can be defined by the following equation:

$$K = \frac{UA_f}{100n} - A_v$$

wherein K is always greater than 0.035; $A_v$ is the cross-sectional area of an individual duct; $A_f$ is the cross-sectional area of the total surface of the filter; U is the percentage of ventilating air in the total flow stream leaving the filter and is defined by the equation:

$$U = \frac{100q_v}{q_v + q_s}$$

wherein $q_v$ is the total flow rate of the ventilating air and $q_s$ is the flow rate of smoke through the filter element; and, n is the number of ducts for the ventilating air and will be at least 3. Preferably, the number of ducts will be 7 or less; the ventilating air will be from 60 to 95 percent of the total flow (ventilating air plus smoke); and, the ratio of the cross-sectional areas of the filter element to the ventilating ducts ($A_v/A_f$) will be less than 0.01 so that most of the smoke is dispersed within 1 cm. for a standard filter (20 to 27 mm. in circumference) from the end of the filter when drawn at the rate of 17.5 cc./sec. Even more preferably, the number of ducts will be 4 or 5; the ventilating air will be from 65 to 90 percent; and, at least 75 percent of the smoke is dispersed within 1 cm. from the end of the filter.

More particularly, the present invention provides a filter cigarette whose filter comprises a porous plug affixed to the end of a cigarette for drawing smoke from the cigarette through the plug, and a plurality of at least three ventilating air ducts positioned and distributed circumambiently around the plug, each of the ducts having an air egress opening at the mouth end of the filter and having an air ingress opening exteriorly of the filter cigarette located remote from the end along the filter, the duct being otherwise closed to prevent the ingress of smoke thereto, the total cross-sectional area of the ducts being much less than the total cross-sectional area of the filter, the ducts and their ingress and egress openings being further selected relative to the plug and cigarette to provide between about 60 percent and about 95 percent ventilating air to the mouth of the user when smoking the filter cigarette, whereby a near total dispersion of the smoke drawn through the filter is obtained within about a one centimeter distance from the end of the filter when drawn at the rate of 17.5 cc./sec.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENTS

Figure 1:
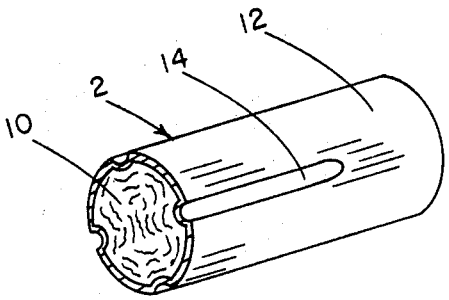
FIG. 1 is a perspective view of one preferred filter element of the present invention.

In FIG. 1, a preferred filter plug 2 of the present invention having a circumference of from 20 to 27 mm. is shown. The filter plug 2 comprises a cellulose acetate filter element 10 or any other filter made from, for example, fibrous or foamed materials for tobacco smoke which may be known in the art circumscribed by a non-porous wrapper 12. It is realized that in the use of the term "non-porous wrapper," this includes non-porous outer surfaces of foamed material which are integral with the filter element as well as non-porous wrapping material which is not integral with the filter element. The filter plug 2 is provided with a plurality of grooves 14 therein extending longitudinally therealong. Although only four grooves are shown symetrically spaced around the filter element, it is realized that the grooves may be randomly spaced wherein the centers of adjacent grooves are at least eight groove radii distance apart that is, for a groove of, for example, 0.0040 sq. cm. (0.05 cm radius), the center of the adjacent grooves will be at least 0.4 cm. from their centers.

The filter plugs 2 are generally prepared by taking a standard filter rod of cellulose acetate or the like wrapped with a non-porous wrapping material, then subjecting the wrapped filter rod to a mold or other treating means designed for putting appropriate grooves therein. One such method is known as a heat molding technique, which is well known in the art.

Figure 2:
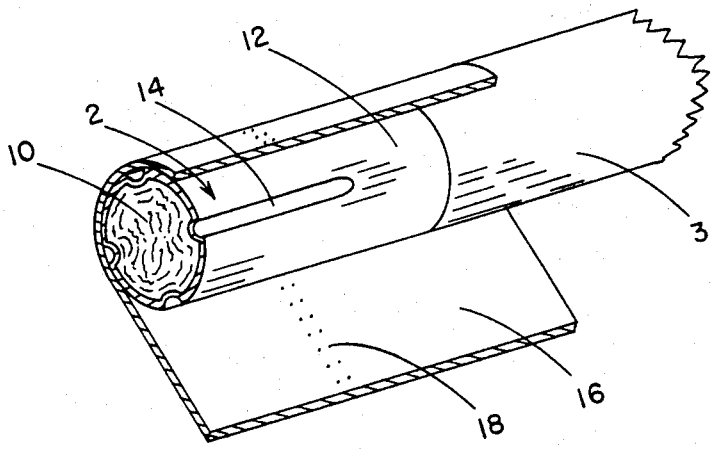
FIG. 2 is a perspective view of the filter of FIG. 1 attached to a cigarette with tipping material shown in an unwrapped condition.

In FIG. 2, a filter plug 2 of FIG. 1 is attached to a tobacco column or cigarette 3 and is positioned for being wrapped by tipping paper 16 which includes a plurality of perforations 18 therein circumferentially surrounding filter plug 2 and disposed for flow communication with the grooves 14 wherein ventilating air radially enters the grooves 14 through the perforations 18. As shown in FIG. 2, ventilating air enters through the tipping perforations 18 traveling down the grooves 14 and toward the smoker's mouth. The size of perforations 18 and the number in flow communication with grooves 14 will be determined in accordance with the amount of ventilating air desired.

Figure 3:
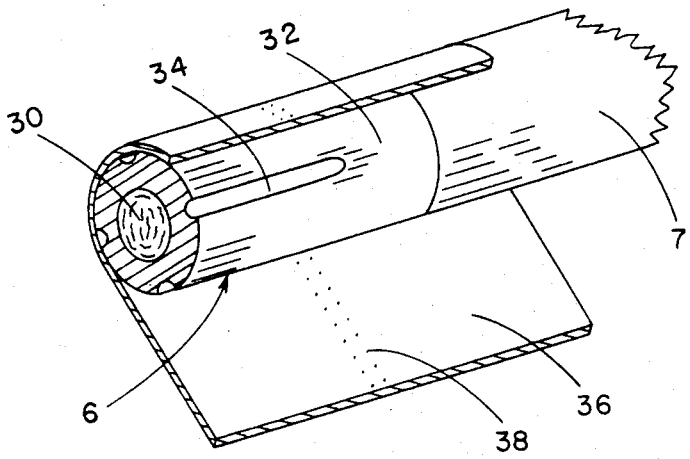
FIG. 3 is a perspective view of even another preferred filter of the present invention attached to a cigarette with tipping material shown in an unwrapped condition.

In FIG. 3, another preferred filter plug 6 of the present invention is shown attached to a tobacco column or cigarette 7 and is positioned for being wrapped by tipping paper 36 which includes a plurality of perforations 38 therein circumferentially surrounding filter plug 6 and disposed for flow communication with the grooves 34 wherein ventilating air radially enters the grooves 34 through the perforations 38. The filter plug 6 is comprised of a cellulous acetate filter element 30 or any other filter made from fibrous or foamed materials for tobacco smoke which may be known in the art enclosed by a tubular plastic sleeve 32. The plastic sleeve 32, may have grooves 34 running only partway of the length along the outer surface as shown, or may extend substantially the entire length. If the grooves 34 extend the entire length, sealing means will be provided to prevent the ingress of smoke from the tobacco column therein or the sleeve will have a cross-sectional area sufficiently greater than the cross-sectional area of the tobacco column so that grooves 34 will be open to the atmosphere. The means for preparing a tubular sleeve may be any known in the art, such as those prepared by extruding.

A more comprehensive understanding of the invention can be obtained by considering the following examples. However, it should be understood that the examples are not intended to be unduly limitative of the invention.

EXAMPLES I–XXIII

A number of cigarettes were prepared by taking a standard cellulose acetate filter element of 24.6 mm. in circumference and 27 mm. in length wrapped with a non-porous wrapping paper from Schweitzer Division, Kimberly-Clark Corporation identified as Type 322. A specified number of grooves were made in each filter and then attached to a cigarette or tobacco column with a tipping paper. The tipping paper was provided with ventilating holes in flow communication with the grooves and the amount of ventilating air introduced was adjusted by varying the size and number of ventilating holes. The cigarettes were then smoked in accordance with the accepted test method of the Federal Trade Commission as noted hereinbefore.

The results for each example are listed in Table 1 below.

TABLE 1

| Example | n[1] | $A_v$[2] | $A_f$[3] | U[4] | K[5] | L[6] |
|---|---|---|---|---|---|---|
| I | 1 | .0025 | .49 | 65 | .316 | — |
| II | 2 | .0025 | .49 | 68 | .164 | 19.1 |
| III | 3 | .0025 | .49 | 68 | .109 | 16.3 |
| IV | 4 | .0025 | .49 | 64 | .076 | 13.5 |
| V | 5 | .0025 | .49 | 67 | .063 | 11.2 |
| VI | 6 | .0025 | .49 | 65 | .051 | 9.5 |
| VII | 7 | .0025 | .49 | 65 | .043 | 8.3 |
| VIII | 8 | .0025 | .49 | 65 | .037 | 7.3 |
| IX | 8 | .0022 | .50 | 82 | .049 | 8.0 |
| X | 31 | .0004 | .52 | 65 | .011 | 4.9 |
| XI | 4 | .0040 | .48 | 85 | .098 | 10.5 |
| XII | 4 | .0040 | .48 | 80 | .092 | 10.5 |
| XIII | 4 | .0040 | .48 | 70 | .080 | 10.5 |
| XIV | 4 | .0040 | .48 | 60 | .068 | 10.5 |
| XV | 4 | .0040 | .48 | 50 | .056 | 10.5 |
| XVI | 4 | .0028 | .50 | 73 | .088 | 12.9 |
| XVII | 4 | .0006 | .52 | 68 | .088 | 28.3 |
| XVIII | 4 | .0014 | .52 | 79 | .102 | 18.9 |
| XIX | 4 | .0073 | .49 | 80 | .091 | 7.7 |
| XX | 4 | .0061 | .49 | 67 | .077 | 8.5 |
| XXI | 4 | .0091 | .50 | 69 | .077 | 6.8 |
| XXII | 4 | .0102 | .50 | 72 | .079 | 6.5 |
| XXIII | 8 | .0008 | .51 | 80 | .050 | 13.4 |

[1]Number of grooves in the filter
[2]Average cross-sectional area of each groove in sq. cm.
[3]Cross-sectional area of filter (including the grooves) in sq. cm.
[4]Percent of ventilating air in the total flow stream
[5]$K = \frac{UA_f}{100n} - A_v$
[6]$L = \frac{\text{Average distance between adjacent grooves}}{\text{Average radius of each groove}}$ From the above examples it was found, by visual appearance, that in Examples III–VII, XI–XIII, and XVI–XVIII, substantially all of the exiting smoke had been dispersed within one centimeter of the exit of the filter. In Examples VIII–X, and XIX–XXIII the ventilating air acted like a sheath and circumscribed the exiting smoke instead of dispersing it. In Examples XIV and XV it appeared that there was insufficient ventilating air to disperse the smoke. Furthermore, in a taste test of the cigarettes, cigarettes of Examples III–VII, XI–XIII, and XVI–XVIII, exhibited exceptional taste amplitude whereas the remaining examples showed a diminished taste. As for Examples I and II, very little smoke dispersion was noted, and very little taste was obtained.

It will be realized that various changes may be made to the specific embodiments shown and described without departing from the principles of the present invention.

What is claimed is:

1. A filter cigarette whose filter comprises a porous plug affixed to the end of a cigarette for drawing smoke from the cigarette through the plug, and a plurality of between three and seven ventilating air ducts positioned and distributed circumambiently around said plug, each of said ducts having an air egress opening at the mouth end of the filter and having an air ingress opening exteriorly of the filter cigarette located remote from said end along the filter, whereby ventilating air can flow from said ingress openings through said ducts to said egress openings, said filter being additionally characterized by the equation:

$$K = \frac{UA_f}{100n} - A_v$$

wherein K is a number greater than 0.035, $A_v$ is the average cross-sectional area of the individual ducts, $A_f$ is the total cross-sectional area of the filter, n is the number of ducts and U is the percent ventilation air for the total flow rate through the filter which is between about 60 and about 95 and is defined by the equation:

$$U = \frac{100q_v}{q_v + q_s}$$

wherein $q_v$ is the total flow rate through the ducts and $q_s$ is the flow rate through the plug, and wherein the filter is further characterized by the equation:

$$A_v/A_f \leqq 0.01$$

whereby substantial dispersion of the smoke drawn through the filter is obtained within about a one centimeter distance from the end of the filter when drawn at the rate of 17.5 cc./sec.

2. The filter of claim 1 wherein U is between about 65 and 90.

3. The filter of claim 1 wherein the plurality of ventilating air ducts is four or five.

4. The filter of claim 1 wherein the filter has a circumference of from 20 to 27 mm.

5. The filter of claim 1 wherein 75 percent of the smoke drawn through the filter is dispersed within about a one centimeter distance from the end of the filter when drawn at the rate of 17.5 cc./sec.

6. The filter of claim 1 wherein the ducts are substantially symmetrically spaced around the porous plug.

7. The filter of claim 1 wherein the centers of adjacent ducts are at least eight duct radii distance apart.

8. The filter of claim 1 wherein the ducts are grooves.

9. The filter of claim 8 wherein the grooves are substantially semi-circular.

* * * * *